United States Patent [19]

Gentry et al.

[11] Patent Number: 4,478,586

[45] Date of Patent: Oct. 23, 1984

[54] BUOYED MOONPOOL PLUG FOR DISCONNECTING A FLEXIBLE FLOWLINE FROM A PROCESS VESSEL

[75] Inventors: Larry L. Gentry, Sunnyvale; Herbert H. Moss, Cupertino, both of Calif.; Narayana N. Panicker, Grand Prairie, Tex.; William T. Wada, Sunnyvale, Calif.

[73] Assignee: Mobil Oil Corporation, New York, N.Y.

[21] Appl. No.: 391,039

[22] Filed: Jun. 22, 1982

[51] Int. Cl.[3] ..... B63B 35/00

[52] U.S. Cl. ..... 441/4; 141/388; 405/195

[58] Field of Search ..... 405/169, 195; 114/230; 166/350, 359, 365, 367; 141/382, 387, 388; 441/3, 4, 5

[56] References Cited

U.S. PATENT DOCUMENTS

| | | | |
|---|---|---|---|
| 3,605,668 | 9/1971 | Morgan | 441/3 X |
| 3,834,432 | 9/1974 | Lilly et al. | 141/388 |
| 4,182,584 | 1/1980 | Panicker et al. | 405/195 |
| 4,367,055 | 1/1983 | Gentry et al. | 405/169 |

*Primary Examiner*—David H. Corbin

*Attorney, Agent, or Firm*—A. J. McKillop; Michael G. Gilman; George W. Hager, Jr.

[57] ABSTRACT

A marine riser system is connected through flowlines and a moonpool plug assembly to a marine vessel. The moonpool plug assembly, when removed from the marine vessel, maintains a fully submerged position due to its having a buoyancy which is less than the net weight of the flowlines to which it is connected.

5 Claims, 7 Drawing Figures

FIG. 4
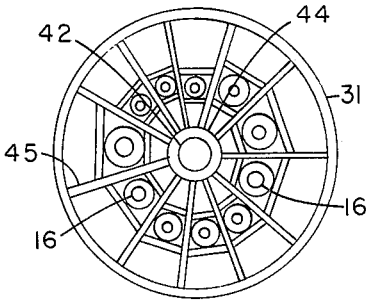
FIG. 2
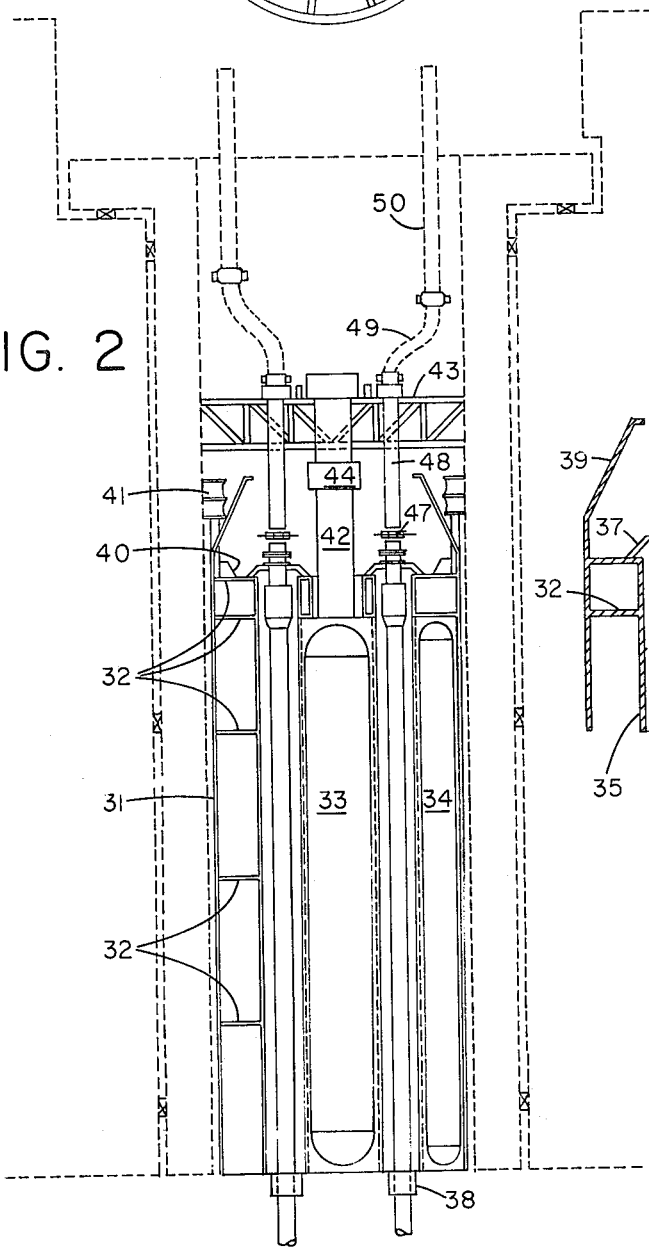
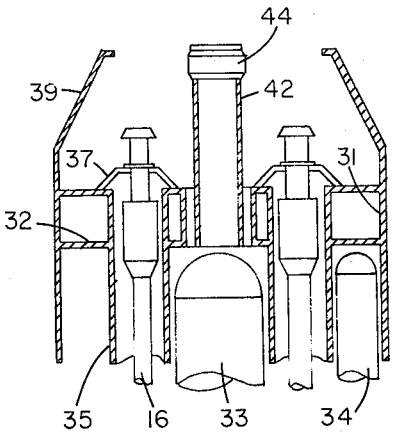
FIG. 3

BUOYED MOONPOOL PLUG FOR DISCONNECTING A FLEXIBLE FLOWLINE FROM A PROCESS VESSEL

BACKGROUND OF THE INVENTION

This invention relates to a marine riser system having flexible flowlines. In particular, it relates to apparatus for connecting a surface facility to a subsea wellhead or gathering system.

In the production of fluid hydrocarbons from deep-water marine oil and gas deposits, a fluid communication system from the marine bottom to the surface after production is required. Such a system, commonly called a production riser, usually includes multiple conduits through which various produced fluids are transported to and from the surface, including oil and gas production lines, service and hydraulic control lines.

In many offshore production areas, a floating vessel can be used as a production and/or storage facility. Since the facility is exposed to surface and sub-surface conditions, it undergoes a variety of movements. In such a zone of turbulence, heave, roll, pitch, drift, etc., may be caused by surface and near surface conditions. In order for a production riser system to function adequately with such a facility, it must be sufficiently compliant to compensate for such movements over long periods of operation without failure.

Such a marine riser is disclosed in U.S. Pat. No. 4,182,584. This compliant riser system includes (1) a lower section which extends from the marine bottom to a fixed position just below the zone of turbulence that exists near the surface of the water, and (2) an upper flexible section which is comprised of flexible flowlines that extend from the top of the rigid section, through the turbulent zone, to a floating vessel on the surface. A submerged buoy is attached to the top of the rigid section to maintain the rigid section in a substantially vertical position within the water.

SUMMARY OF THE INVENTION

In accordance with the present invention there is provided a method and system for disconnecting a marine compliant riser from a surface facility in a subsea production gathering system wherein a negative buoyancy flowline bundle is supported between a submerged fixed position buoyed riser section and a buoyant moonpool plug in a negative-buoyancy catenary flowline arrangement. Ballasts establish a positive buoyancy for the moonpool plug which is substantially less than the negative buoyancy of the flowline bundle. The moonpool plug may be tethered to a surface buoy to maintain the moonpool plug in a submerged and spaced apart position from the fixed portion of the marine riser system so as to prevent damage. The positive buoyancy of the moonpool plug is maintained at about one-half the negative buoyancy of the flowline bundle, whereby the moonpool plug descends to a subsea level approximately equal to that of the top of the fixed riser position.

The moonpool plug includes a cylindrical plug sheel adapted for being drawn into a rotary vessel moonpool located in the surface facility. A central column releasably attaches the moonpool plug to the vessel moonpool for rotation therewith. An internal plug support structure attaches the support column to the plug shell. A plurality of guide tubes are connected to the internal plug support structure and are disposed in radial array around the central columns for housing the flexible flowlines. A plurality of elongated buoyant tanks are located inside the plug shell between the guide tubes. A plurality of transverse diaphragm plates secure the guide tubes and the tanks to the plug shell.

BRIEF DESCRIPTION OF THE DRAWINGS

FIGS. 2–4 are partial cross sectional views of the moonpool plug assembly of the present invention.

DESCRIPTION OF THE PREFERRED EMBODIMENT

Figure 1:
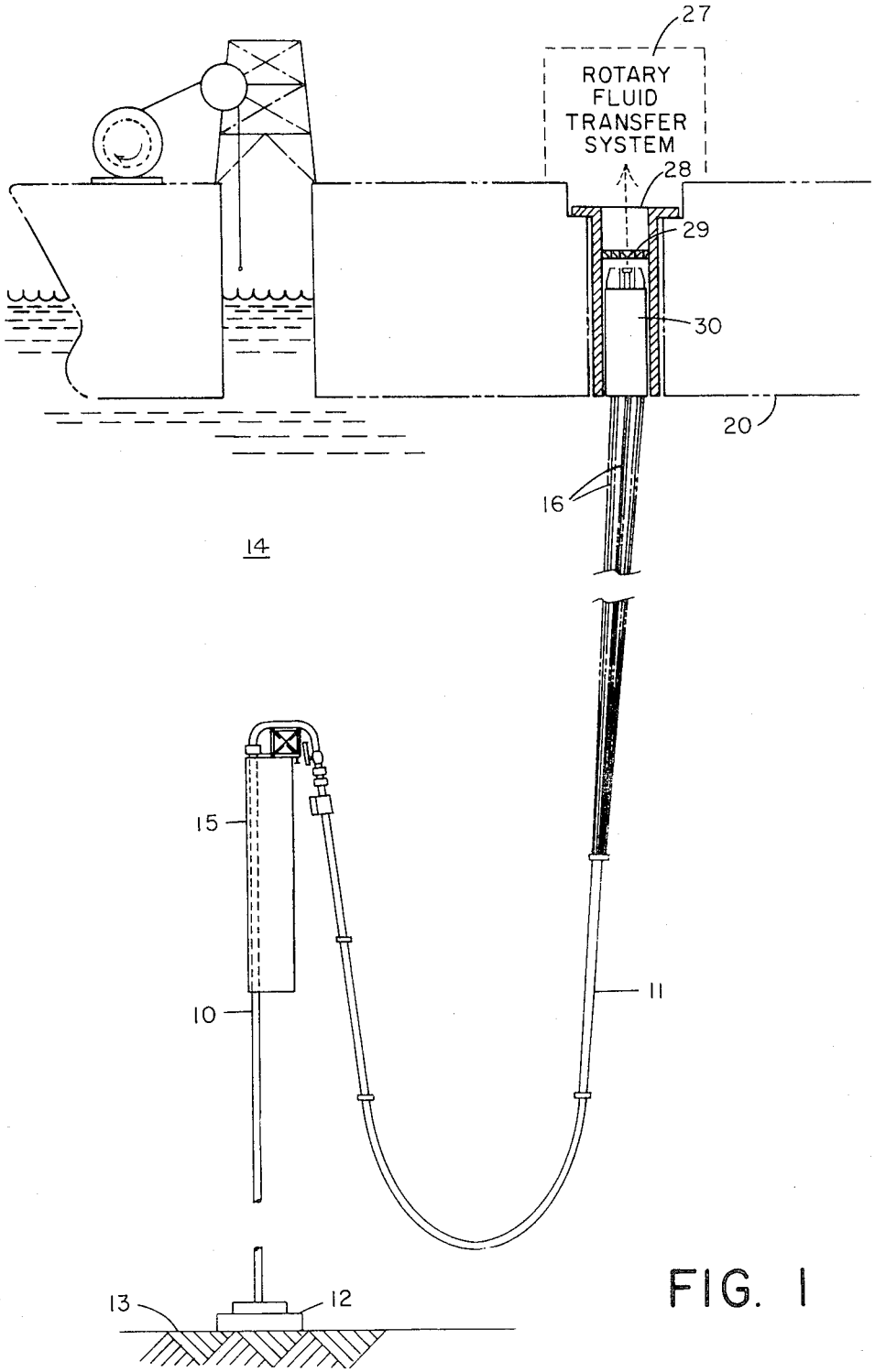
FIG. 1 illustrates a marine riser system and floating vessel with which the moonplug assembly of the present invention may be utilized.

Referring now to the drawings, FIG. 1 discloses marine compliant riser system 10 in an operational position at an offshore location. The riser system has a lower rigid section 10 and an upper flexible section 11. Lower rigid section 10 is affixed to base 12 on marine bottom 13 and extends upwardly to a point just below turbulent zone 14, which is that zone of water below the surface which is normally affected by surface conditions, e.g., waves, currents, surface winds, etc. Buoy section 15 is positioned at the top of rigid section 10 to maintain rigid section 10 in a vertical position under tension. Flexible section 11 has a plurality of flexible conduits 16 which are operatively connected to respective flow passages in rigid section 10 at buoy section 15. Flexible section 11 extends downwardly from buoy section 15 through a catenary path before extending upwardly to the surface, where it is connected to the floating facility 20.

The catenary flowline configuration permits safe fluid transport even though there is considerable variation of the surface vessel position relative to the fixed position riser section. Variations in rotational attitude during weathervaning of a production vessel can be compensated by having a rotary connection in moonpool 28. By providing a rotary fluid transfer sub-system aboard ship to permit fluid coupling during vessel weathervaning, the surface end of flowline bundle 11 can be stabilized at a relatively fixed attitude. The surface facility also undergoes lateral surface excursion toward and away from the lower riser position, for instance, an equivalent length of up to $\frac{1}{2}$ the total flexible section overall length. Ordinarily, the surface facility should be capable of safe operation throughout an azimuth of $\pm 45°$. This operational sector or "watch circle" can be accommodated with the present compliant riser system, while maintaining acceptable stress distribution throughout the submerged connection subsystems.

The catenary deparature angle of the flowline bundle increases as the surface vessel excursion from the lower riser section increases. Of course, a vessel moored directly over the rigid riser will have its flowlines disposed at a near vertical angle (essentially 0° departure). In a typical system where the flexible bundle length is three times ($3\times$) the riser connection depth L, as the excursion increases from 0 to $1\frac{1}{2}$ L, the normal catenary angle increases to about 20°.

The moonpool contains a circular turret into which a moonpool plug is selectively pulled, whereby the turret is effectively closed so that dynamic loads on the plug are reduced in heavy seas because rise and fall of water in the turret is minimized. Preferably, the rotary moonpool and the moonpool plug are cylindrical in shape but may be conical, for example. This plug comprises a plurality of circularly arranged openings through which the discharge ends of all of the flexible pipes to be assembled in the flowline bundle are pulled from the service moonpool, whereby the discharge ends are all above water level to allow manual inspection and replacement of connection components. A structural support frame is attached to the walls of the cylindrical turret, and the plug is rotatably and detachably connected to the sides of the turret below this support frame. A rotating device, attached to the turret, selectively rotates the plug for any minor alignment of flexible pipe bundle necessary for the connection.

A plurality of elongated connectors are supported by this frame and are selectively connected at their lower ends to the discharge ends of the individual hoses, whereby the heavy hoses are supported independently of the plug with a constant upward force which minimizes upward and downward mechanical motions that might cause fatigue loads. These connectors are locked and unlocked by remote control, and the upper ends of the connectors are connected to vertically disposed production piping, one pipe for each of the hoses, which is disposed within the turret.

The process vessel further contains the rotary fluid transfer subsystems of this invention for transferring production fluids, electrical power, hydraulic power, and control signals across rotating interface between the offshore process vessel and the flowline bundle and the tensioning means of this invention for maintaining a selected tension on terminal hoses between the interface and storage facilities on the vessel. The subsystem and tensioning means enable the vessel to continue to receive production fluids from the riser section while weathervaning under power around its plug and while functioning on a 24-hour basis as a maintenance depot for the underwater flowlines.

Referring now to FIGS. 2–4, the moonpool plug assembly 30 includes a cylindrical shell 31 with spaced, horizontal diaphragm plates 32 for structural integrity. A tapered portion 39 assists in a smooth entry and exit of the moonplug when pulled into the moonpool 28. Remotely actuated mechanical latches 40 operate in conjunction with mechanical stops 41 on the moonpool wall to ensure the moonpool plug is positively connected. The assembly includes a central variable ballast tank 33 surrounded by fixed buoyancy ballast tanks 34. Quide tubes 35 provide guidance, alignment and passage for the individual flexible flowlines 16. The flowlines 16 are supported at the top of the guide tubes 35 by the support pedestals 37. Segmented hose supports 38 at the bottom of the guide tubes 35 adjacent the vessel keel line minimize bending damage to the flowlines 16.

A central support column 42 releasably attaches the moonpool plug 30 to the main structural support frame 43 at the turret moonpool 28 for rotation therewith. Hydraulic connector 44 is provided as a remote release during an operational disconnection of the moonpool plug. The support column is attached to the moonpool plug by way of an internal support structure 45.

The flowlines 16 pass through the guide tubes 35 and terminate at a point above the support pedestals 37. At this point remote releasable hub and clamp connectors 47 connect each of the flowlines 26 to a straight length of vertical production piping 48. Piping 48 connects to offset pieces 49 and then to vertical production piping 50.

Figure 5:
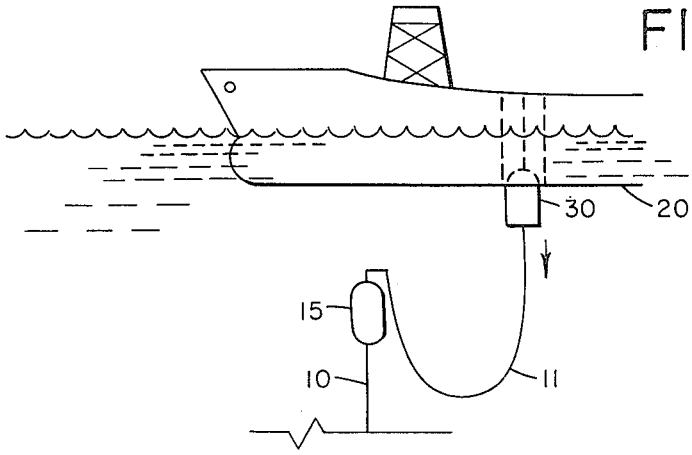
FIGS. 5–7 illustrate a method of disconnecting the marine riser system of FIG. 1 from the marine vessel by removing the moonpool plug assembly from the marine vessel.
Figure 6:
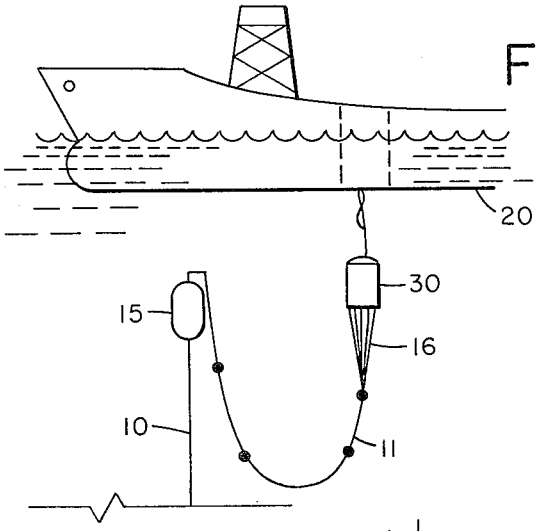
Figure 7:
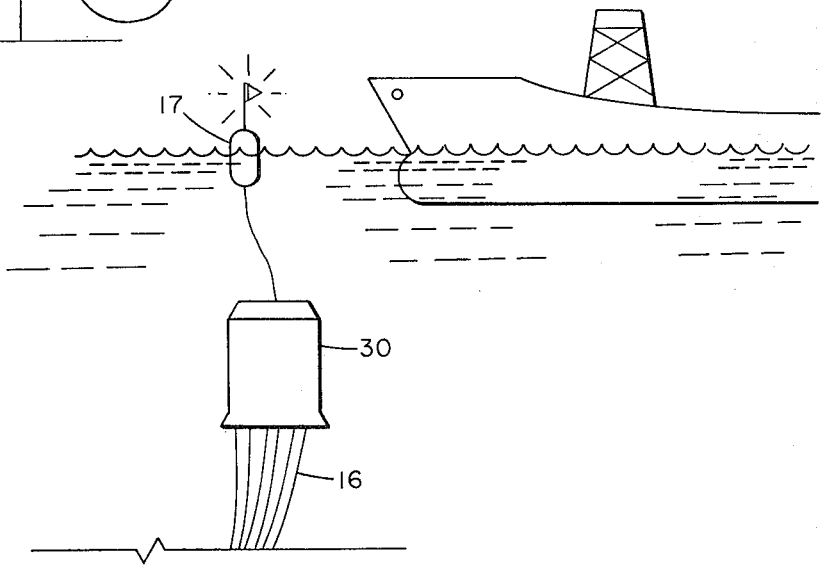

When disconnecting the marine compliant riser 10 from the surface facility 20, such as in cases of inclement weather or equipment failure, the moonpool plug 30 is removed from the vessel moonpool 2 as shown in FIG. 5. The buoyancy tanks 33 and 34 establish a positive buoyancy for the moonpool plug 30 which is substantially less than the negative buoyancy of the flexible flowlines 26. In this manner the moonpool plug 30 is fully submerged to a balanced buoyancy position supporing an end of the flexible section 11 of flowlines 16 in a lowered catenary position as shown in FIG. 6. In one embodiment, the positive buoyancy of the moonpool plug 30 is maintained at about one-half the negative buoyancy of the flexible section 11, whereby the moonpool plug 30 descends to a subsea level equal to that of the buoy section 15 at the top of the compliant riser 10. The moonpool plug 30 is maintained at such level in a spaced-apart position from the compliant riser to prevent damage to the compliant riser. The moonpool plug is then tethered to the surface buoy 17 as shown in FIG. 7 or to surface vessels so as to maintain such spaced-apart position.

The foregoing description relates to only a preferred embodiment of the invention and it should be understood that various modifications or alterations may be made without departing from the spirit and scope of the invention as set forth in the appended claims.

What is claimed is:

1. A buoyant moonpool plug for connecting a subsea flowline to a surface vessel comprising:

a cylindrical plug shell adapted for being drawn into a vessel moonpool;

central support column means for releasably attaching the moonpool plug to the turret of said vessel moonpool for rotation therewith;

internal plug support structure for attaching the support column to the plug shell at an upper portion of the plug shell;

a plurality of guide tubes connecting to the internal plug support structure and disposed in radial array around the central support column, said guide tubes extending downwardly to the bottom end of the plug shell for housing said subsea flowline;

a plurality of elongated buoyant tanks located inside the plug shell between guide tubes; and a plurality of transverse diaphragm plates for securing the guide tubes and tanks to the plug shell.

2. The moonpool plug of claim 1 wherein at least one of said tanks is a variable ballast tank.

3. The moonpool plug of claim 1 wherein the plug shell is inwardly tapered at the top to facilitate insertion of the plug into a vessel moonpool, and wherein the central support column has a rotary connector extending above the plug shell.

4. The moonpool plug of claim 1 wherein the internal plug support structure provides split ring means for holding a conduit terminal at the upper end of guide tubes.

5. The moonpool plug of claim 1 wherein said guide tubes have lower conduit access protection means for preventing damage to flexible conduits by lower guide tube openings.

* * * * *